US006050851A

United States Patent [19]

Kajiura et al.

[11] Patent Number: 6,050,851

[45] Date of Patent: Apr. 18, 2000

[54] ELECTRIC CONNECTOR

[75] Inventors: Motomu Kajiura, Tokyo, Japan; David J. Dutkowsky, Singapore, Singapore; Hidehiro Shindo, Chiba, Japan

[73] Assignee: Berg Technology, Inc., Reno, Nev.

[21] Appl. No.: 09/096,242

[22] Filed: Jun. 11, 1998

[30] Foreign Application Priority Data

Jun. 20, 1997 [JP] Japan ..... 9-005327

[51] Int. Cl.[7] ..... H01R 13/73

[52] U.S. Cl. ..... 439/570

[58] Field of Search ..... 439/563, 566, 439/567, 570, 571, 83, 572, 41

[56] References Cited

U.S. PATENT DOCUMENTS 5,133,452 7/1992 Ohashi ..... 206/328
5,201,664 4/1993 Korsunsky et al. ..... 439/83
5,259,789 11/1993 Patel et al. .
5,263,867 11/1993 Doi et al. ..... 439/62
5,352,851 10/1994 Wallace et al. ..... 174/52.4
5,395,265 3/1995 DiMondi et al. .
5,411,236 5/1995 Morita et al. .

*Primary Examiner*—Gary F. Paumen
*Attorney, Agent, or Firm*—Daniel J. Long; Brian J. Hamilla; M. Richard Page

[57] ABSTRACT

An electric connector is provided which can enhance a mounting density on a printed circuit board, and improve tail protection during transportation. An electric connector (1) of the present device includes a housing (2) which is molded out of an electric insulating material and has a lower face facing a printed circuit board B when being mounted on the printed circuit board and an upper face situated opposite to the lower face, a plurality of terminals (4) as an electric contact, which are retained at predetermined intervals along the longitudinal direction of the housing (2) and each have a tail portion 6 projecting from the lower face of the housing (2) and soldered to the printed circuit board B, and a retaining member (12) which is fitted on both sides in the longitudinal direction of the housing (2) and holds down the housing (2) on the printed circuit board B from its top by being soldered to the printed circuit board B.

9 Claims, 3 Drawing Sheets

ELECTRIC CONNECTOR

BACKGROUND OF THE INVENTION

1. Field of the Invention

The present device relates to an electric connector mounted on a printed circuit board, and in particular, to a surface-mount type electric connector.

2. Brief Description of Prior Developments

In general, an electric connector comprises a housing, and a plurality of terminals functioning as an electric contact, which are retained in the housing. In case of mounting the electric connector on a printed circuit board, a distal end portion of each terminal is accurately soldered onto a predetermined position on the printed circuit board.

In the case where a mating connector is attached to and detached from the connector mounted on the printed circuit board, generally, a stress is applied onto the soldered distal end portion (hereinafter, referred simply to as "solder tail") of the terminal on the mounted side. In particular, in the case where the mating connector is drawn out from the connector on a mount side, a considerably great stress is applied onto the solder tail. In order to reduce a stress applied to the solder tail in attaching and detaching the mating connector, the electric connector to be mounted on the printed circuit board is provided with, for example, a reinforcement member (hereinafter, referred simply to as "hold down member") for fixing the electric connector onto the printed circuit board, at its both side ends in the longitudinal direction. Specifically, the hold down member fixed on the printed circuit board receives a connector draw-out direction force so that an excessive stress is not applied onto the solder tail of the terminal. Conventionally, the aforesaid hold down member includes a type of holding down a connector from its lower side (mounting surface side), and a type of holding down a connector from its upper side (side opposite to the mounting surface side)(see U.S. Pat. No. 5,263,867).

An assembled connector is carried after being collectively received in a transportation tray with a predetermined number of articles. In this case, the tray is formed with a plurality of receiving grooves for each receiving the connector. In order to achieve tail protection for preventing a stress from applying to a solder tail of a terminal during transportation, the receiving groove is formed into a shape as shown in FIG. 6. Specifically, the bottom face of a receiving groove 100 is formed with a projecting portion 102 along the longitudinal direction thereof. The projecting portion 102 raises the housing of a connector 104 upward; therefore, a solder tail 105 and the bottom face of the groove 100 is prevented from contacting with each other so that a stress is not applied to the solder tail. Also, a width W1 of the receiving groove 100 is set larger than a width W2 of the connector 104 so that the solder tail 105 does not contact with side walls of the receiving groove 100. In particular, the surface-mount type connector 104 as shown in figure requires an accurate flatness of the solder tail 105. In this case, it is important that tail protection during transportation is achieved by forming the groove into the aforesaid shape.

In the process for manufacturing of the connector, first, a housing as molding product is carried to a predetermined supply stage by means of a transportation rail, and is fed from the supply stage to an assembly machine. And then, a plurality of terminals are driven into (pressed in) the housing by means of the assembly machine. In the final stage of the manufacture process, a hold down member is attached to both sides of the connector. At this time, the hold down member for holding the connector from its lower side (mounting surface side) is attached from the substantially same direction as an assembly direction of driving the terminals into the housing. Therefore, a head of the assembly machine is used in common with a process for driving the terminals and a process for attaching the hold down member, so that the machine can be, as a whole, simplified. However, this type of hold down member does not withstand against a force of drawing out the connector, as compared with the hold down member for holding down the connector from its upper side, that is, the hold down member disclosed in U.S. Pat. No. 5,263,867. On the other hand, the hold down member disclosed in U.S. Pat. No. 5,263,867 sufficiently withstands against the force of drawing out the connector. However, the hold down member is attached on a base extending from both sides in the longitudinal direction of the connector so as to be fitted from top;—for this reason, the hold down member projects from both sides of the connector. As a result, the hold down member occupies a relatively large space on a printed circuit board. Therefore, this causes a problem of lowering a mounting density of electric components on a printed circuit board.

Also, the hold down member disclosed in U.S. Pat. No. 5,263,867 is formed by bending a flat plate. Thus, the maximum mechanical strength depends upon a strength of a bent portion. Moreover, the hold down member has four bent portions; for this reason, a tolerance in each bent portion is accumulated, and there occurs a great error in a dimension of the finished hold down member. Therefore, there can not be obtained a preferable flatness in a portion of the hold down member to be soldered to the surface of the printed circuit board. In such a case, it is impossible to perform surface mounting of the connector in a preferable state even if the solder tail has an accurate flatness.

In an automatic mounting process of the connector, the connector is sucked up one by one from a transportation tray by means of a specific nozzle, and then, is carried onto the printed circuit board. Therefore, it is important that the connector is received in the receiving groove (see FIG. 6) of the tray T with directivity in some degree. In the case where the receiving groove 100 of the tray T is formed into a shape as shown in FIG. 6, however, the connector is shaky in the groove 100 during transportation, and a minimum directivity required for the connector is not obtained in the automatic mounting process. In particular, tail protection can be sufficiently achieved. Specifically, as shown in FIG. 6, the connector 104 is raised up by the projecting portion 102 of the receiving groove 100, and there is a clearance defined between the connector 104 and side walls of the receiving groove 100. If the connector 104 is placed in such a state, the connector 104 becomes unbalance and is shaky during transportation. For this reason, the solder tail 105 abuts against the side wall of the receiving groove 100; as a result, a stress is applied thereto.

It is considered as one means for solving the above problem that the tray side is provided with a projecting portion at a not-contact position with the solder tail, and the projecting portion is abutted against the housing of the connector so as to position the connector. However, if a demand for accuracy is made in the tray side in order to obtain a directivity of the connector required for the automatic mounting process and to achieve tail protection, the tray itself becomes expensive. In fact, in the automatic mounting process of the connector, the connector is taken out from the tray by means of the specific nozzle, and thereafter, the directivity of connector is corrected with precision by a camera monitor. Thus, when the connector is received in the tray, a directivity may be merely given to the connector in some degree. Therefore, high precision for the tray is not necessary. Taking the above circumstances into consideration, it is considered that the housing of the connector is provided with a projecting portion which abuts against the side wall of the receiving groove of the tray. However, if the housing is provided with such projecting portion, there is a need of widening a width of a transportation rail for supplying the housing to the assembly machine in a manufacture process of the connector in accordance with the projecting portion. Consequently, some measures must be taken against the connector manufacture machine side. Also, if the width of the transportation rail is widened, there is a possibility that the connector is shaky on the rail. Therefore, the connector can not be carried in a state of being tightly positioned, and protection of the solder tail having an accurate flatness can not be achieved.

It is accordingly the object of the present device to provide an electric connector which can perform a preferable surface mounting of a connector onto a printed circuit board with sufficiently hold down strength, and can enhance a mounting density on the printed circuit board. Further, it is another object of the present device to provide an electric connector which can improve tail protection during transportation without causing failure in a connector manufacture process and increasing a manufacture cost of a connector transportation tray.

SUMMARY OF THE INVENTION

In order to achieve the above-mentioned objects of the present device, there is provided an electric connector mounted on a printed circuit board, comprising:

- a housing which is molded out of an electric insulating material, and has a lower face facing a printed circuit board when being mounted to the printed circuit board and an upper face situated opposite to the lower face;
- a plurality of terminals as an electric contact, which are held at predetermined intervals along a longitudinal direction of the housing, and each have a tail portion projecting from the lower face of the housing and soldered to the printed circuit board; and a retaining member which is fitted on both sides of the housing in the longitudinal direction thereof, and holds down the housing on the printed circuit board from its top by being soldered to the printed circuit board.

With the above construction, the housing is held down on the printed circuit board from its top by means of the retaining member. Specifically, the retaining member fixes the housing on the printed circuit board with sufficient hold down strength, and receives a force caused when the mating connector is drawn out from its opposite side, thereby preventing a stress from being applied to the solder tail of the terminal. Thus, the electric connector withstands against a force in a draw-out direction. Also, since the retaining member is fitted on both sides in the longitudinal direction of the housing, the retaining member does not project from both sides of the connector, and this serves to make small a space occupied by the connector on the printed circuit board. Therefore, a mounting density of electric components on the printed circuit board can be enhanced. In particular, since the retaining member is provided so as to cover a train of terminals from both sides in the longitudinal direction, even if the connector is shaky in its longitudinal direction in the connector receiving groove of the connector transportation tray, the retaining member can prevent a contact of the solder tail and the side walls of the connector receiving groove. In the electric connector of the present device, the retaining member is provided with positioning means which positions the housing in the connector receiving groove of the connector transportation tray. In this case, the positioning means is provided at both side ends of the retaining member. Further, the positioning means is projecting portion which abut against side walls of the connector receiving groove formed in the transportation tray and which position the housing so as to prevent the tail portion and the side walls of the connector receiving groove from contacting with each other in the connector receiving groove. With the above construction, the connector is accurately positioned in the connector receiving groove, and also, the connector is prevented from being rotated or shaky. Therefore, tail protection during transportation can be securely achieved. The aforesaid retaining member may be provided with an engagement portion for momentarily holding the retaining member on the printed circuit board by engaging with the printed circuit board. In this case, this serves to facilitate a soldering operation because the connector is no shaky when soldering the terminals and the fixed portion of the retaining member onto the printed circuit board.

DETAILED DESCRIPTION OF THE INVENTION

One embodiment of the present device will be explained below in detail with reference to the accompanying drawings.

Figure 1A:
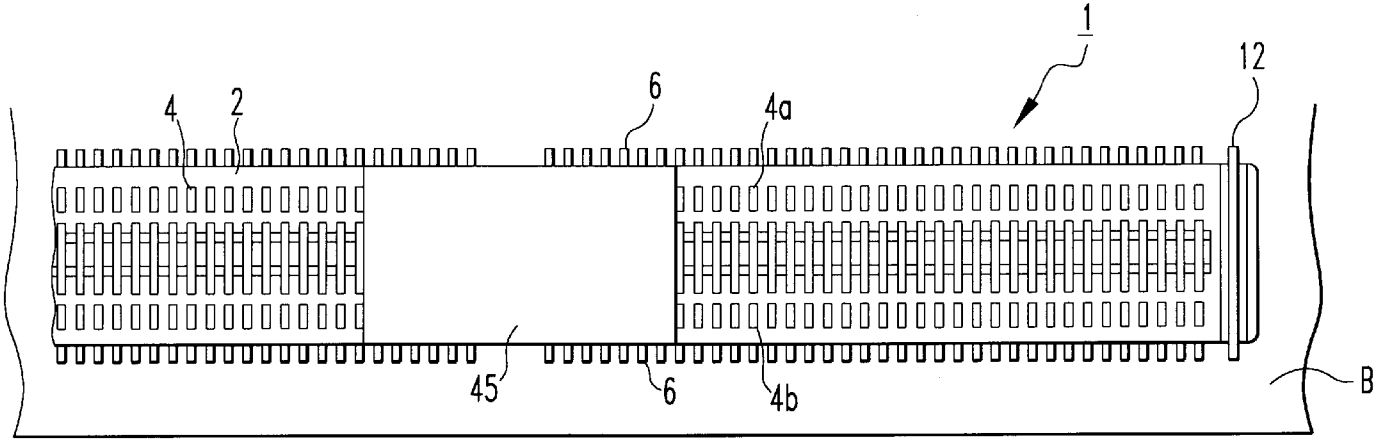
FIG. 1(*a*) is a plan view of an electric connector which is one preferred embodiment of the present device, FIG. 1(*b*) being a side view of the electric connector shown in FIG. 1(*a*), and FIG. 1(*c*) being a front view of the electric connector shown in FIG. 1(*a*)
Figure 1B:
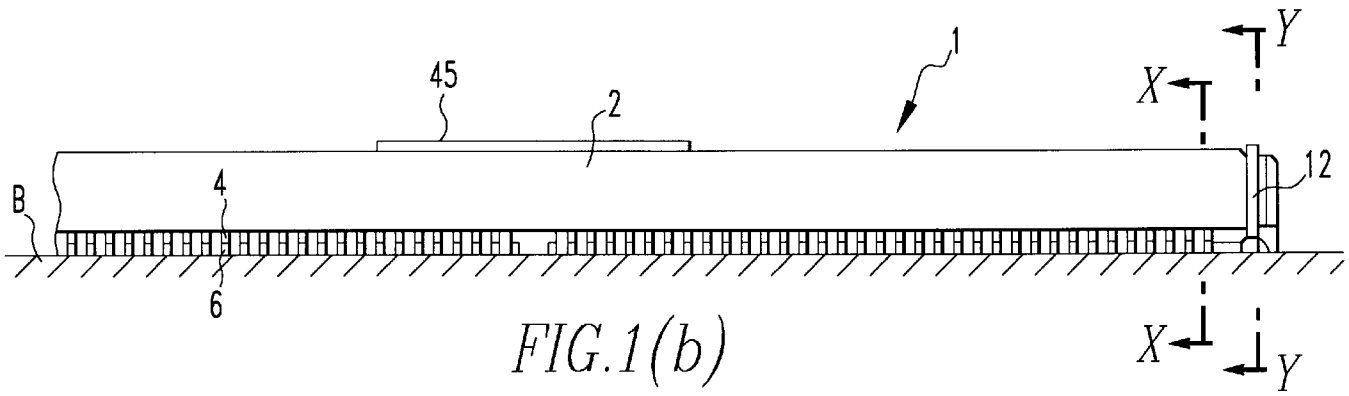
Figure 1C:
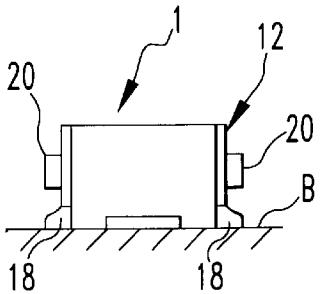
Figure 2:
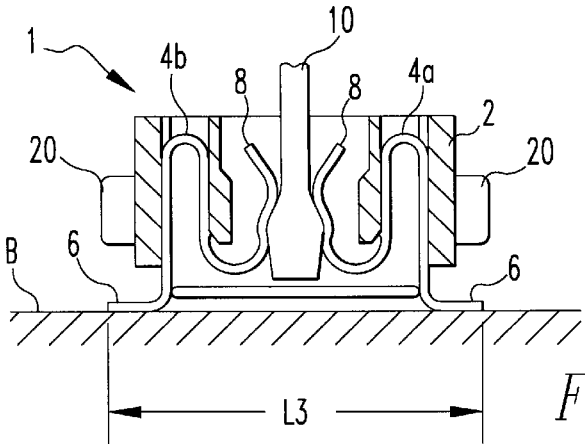
FIG. 2 is a cross-sectional view as taken along Line X—X in FIG. 1(*b*)
Figure 3:
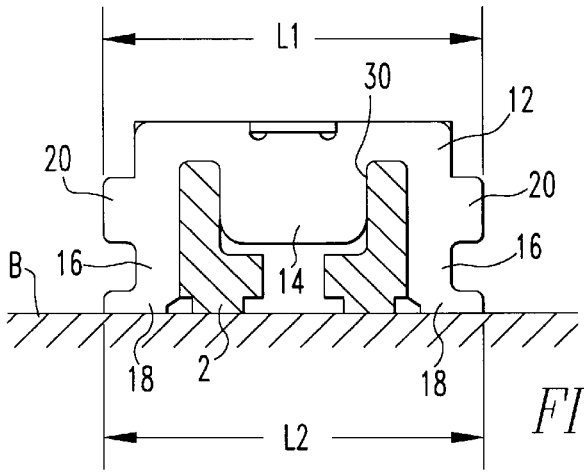
FIG. 3 is a cross-sectional view as taken along line Y—Y in FIG. 1(*b*)

FIG. 1 shows a surface-mount type electric connector according to one embodiment of the present device. As shown in FIG. 1, the electric connector comprises a housing 2 which is made of an insulating material and is molded into an integral structure, and a plurality of female terminals 4 which are received in the housing in a state of being mutually insulated and function as an electric contact. These plurality of female terminals 4 are collectively driven into the housing 2 by means of an assembling machine (not shown) so that they are arranged at predetermined intervals along a longitudinal direction of the housing 2. As shown in FIG. 2, each female terminal 4 comprises a pair of terminal sections 4*a* and 4*b*. Each of the terminal sections 4*a* and 4*b* has one end portion 6 soldered onto a predetermined position of a printed circuit board B, and the other end portion 8 connecting with a male terminal 10 of a mating connector, and are held in the housing 2 in a state in which a portion between both ends of the terminal section is bent. As shown in the figure, when the male terminal 10 of the mating connector is inserted between the other end portions 8 and 8 of the terminal sections 4*a* and 4*b*, an electric connection is made between the connector and the mating connector. Also, one end portion 6 of respective terminal sections 4*a* and 4*b* are bent outwardly with a predetermined flatness (so as to become parallel with a mount surface of the printed circuit board B), and project into the side of the housing 2, thus forming solder tails to be soldered onto the printed circuit board B.

Both end sides in the longitudinal direction of the housing 2 are fitted with a hold down member 12 for fixing the electric connector I onto the printed circuit board B so as to cover the female terminal 4 from both sides in the longitudinal direction. The hold down member 12 is formed into a thin plate by being subjected to blanking. Further, the hold down member 12 has a convex portion 14 which is fitted into a concave groove 30 provided on the upper portion of the housing 2, and a pair of leg portions 16 and 16 which are formed integrally with the convex portion 14 and fitted along the side face of the housing 2.

A lower end portion of each leg portion 16,16 extends in a manner of being bent into the outside with a predetermined flatness (so as to become parallel with a mount surface of the printed circuit board B), and thus, is formed with a fixed portion 18 to be soldered onto a predetermined position of the printed circuit board B. Also, each leg portion 16,16 is formed with a projecting portion 20 projecting toward the side. The projecting portion 20 has a projection length which is set so that the projecting portion 20 abuts against a side wall of a receiving groove 50 of a transportation tray T which will be described later. Specifically, a length L, between the projecting portions 20 and 20 is set to the substantially same as a width W (see FIG. 4) of the receiving groove 50 so that the connector 1 can be stably positioned in the receiving groove 50 when the projecting portion 20 and 20 on both sides of the hold down member 12 abut against both side walls of the receiving groove 50. In a manufacture process of the electric connector 1 constructed as described above, first, the housing 2 as a molding product is carried onto a predetermined supply stage by means of a transportation rail, and is fed from the supply stage to an assembling machine. And then, the plurality of female terminals 4 are collectively driven into the housing 2 by means of the assembling machine. In the final stage of the manufacture process, the hold down member 12 is attached onto both sides in the longitudinal direction of the housing 2. More specifically, the hold down member 12 is fitted into the concave groove 30 provided on the upper portion of the housing 2 while its leg portions 16 and 16 being fitted along the side face of the housing 2. In this case, the hold down member 12 is attached from a direction of substantially converse to an assembly direction of driving the female terminals 4 into the housing 2 (the side converse to the mount surface of the connector 1).

Figure 4:
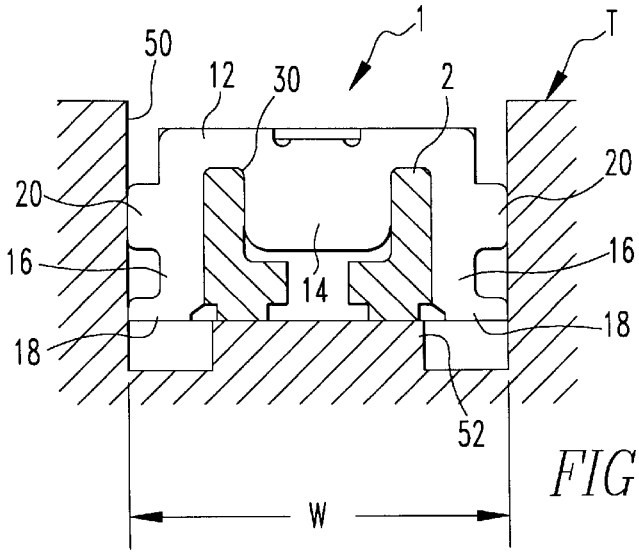
FIG. 4 is a cross-sectional view as taken along a connector width direction in a state in which the electric connector of FIG. 1 is received in a receiving groove of a transportation tray.

The assembled connector 1 is transported after being collectively received in a transportation tray T having a plurality of receiving grooves 50 with a predetermined number of articles. In this case, the electric connector 1 is received in each receiving groove 50 in a state as shown in FIG. 4. Specifically, a bottom face of the receiving groove 50 is formed with a projecting portion 52 along its longitudinal direction. The housing 2 of the connector I is raised upward by means of the projecting portion 52, so that the solder tail 6 does not contact with the bottom face of the receiving groove 50; therefore, no stress is applied to the solder tail 6. Also, the width W of the receiving groove 50 is set larger than a substantial width of the connector I so that the solder tail 6 does not contact with the side wall of the receiving groove 50. In such a state, there is a possibility that the connector I is shaky during transportation. However, in the present embodiment, the projecting portions 20 and 20 on both sides of the hold down member 12 are abutted against both side walls of the receiving groove 50, so that the connector 1 is accurately positioned in the receiving groove 50; therefore, the shakiness accompanying with rotation and vibration of the connector 1 can be prevented. Even if the connector 1 is shaky in its longitudinal direction due to vibration by transportation, the solder tail 6 and the side wall of the receiving groove 50 is prevented from contact with each other by means of the hold down member 12 covering the female terminals 4 from both sides in its longitudinal direction, thus, tail protection can be securely achieved.

In an automatic mounting process of automatically mounting the connector 1 onto the printed circuit board B, the connector 1 is sucked up by one from the tray T by means of a specific nozzle, and then, is carried onto the printed circuit board B. In this case, a Kapton tape 45 (see FIG. 1) made of a polyimide film is stack onto the upper face of the connector 1. The Kapton tape 45 is used as an absorption face for sucking up the connector 1 by means of the specific nozzle. Then, the connector 1 is situated on a predetermined position on the printed circuit board, and thereafter, is mounted on the printed circuit board B by being subjected to reflow soldering. More specifically, the solder tail 6 of the female terminal 4 is soldered to a predetermined position of a printed circuit on the printed circuit board B, and also, the fixed portion 18 of leg portion 16 of the hold down member 12 is soldered to the predetermined position of the printed circuit board B. In such a state, the housing 2 is pressed from its top by means of the hold down member so as to be firmly held on the printed circuit board B. The Kapton tape 45 is peeled off from the connector 1 by a user after being subjected to soldering.

As described above, in the electric connector 1 of this embodiment, the housing 2 is held down on the printed circuit board B from its top by means of the hold down member 12. Specifically, the hold down member 12 fixes the housing 2 on the printed circuit board B with sufficient hold-down strength, and receives a force acting when drawing out the mating connector from the connector 1 from side opposite to the acting force, so that a stress can be prevented from excessively applying to the solder tail 6 of the female terminal 4. Thus, the electric connector I sufficiently withstands against the force in a draw-out direction.

Further, in the electric connector 1 of this embodiment, the thin formed hold down member 12 is fitted on both side ends in the longitudinal direction of the housing. For this reason, the hold down member 12 does not project from both sides of the connector 1, so that a space occupied by the connector 1 on the printed circuit board B is smaller as compared with that of a connector disclosed in U.S. Pat. No. 5,263,867.

Therefore, this serves to enhance a mounting (packaging) density of electric components on the printed circuit board B. Also, the hold down member 12 is located so as to cover the female terminal 4 from its both side in the longitudinal direction. Even if the connector 1 is shaky in its longitudinal direction in the receiving groove 50 of the tray T due to vibration during transportation, the hold down member 12 can prevent the solder tail 6 and the side walls of the receiving groove 50 from contacting with each other.

Namely, tail protection during transportation can be securely achieved in the longitudinal direction of the connector 1. Furthermore, in the electric connector 1 of this embodiment, the hold down member 12 is provided with the projecting portions 20 which abut against both sides both side walls of the receiving groove 50 of the tray T at its both sides. Therefore, the connector 1 is accurately positioned in the receiving groove 50, so that the connector 1 can be prevented from being rotated and shaky. Namely, tail protection during transportation can be securely achieved in the width direction of the connector 1. Also, since the tray T and the housing 2 are not provided with the projecting portion 20, there is no need of making large a width of the transportation rail for feeding the housing 2 to the assembly machine in the connector manufacture process in accordance with the projecting portion 20. Thus, the tray T is not required having strictly precision. In other words, tail protection during transportation can be improved without causing failure in the connector manufacture process and increasing manufacture cost of the transportation tray T. In the final stage of the connector manufacture process, the hold down member 12 is attached to the housing 2, therefore; there is no need of widening the width of the transportation rail and taking specific measures against the connector manufacture machine side even if the hold down member 12 is provided with the aforesaid projecting portions 20.

Also, in the electric connector 1 of this embodiment, the hold down member 12 is formed by being subjected to blanking. Therefore, the hold down member 12 is formed considerably thin with high dimensional accuracy. As a result, there can be obtained a preferable flatness of the fixed portion 18 of the hold down member 12 soldered onto the surface of the printed circuit board B. Moreover, by making use of the flatness of the solder tail 6, the connector 1 can be mounted on the surface of the printed circuit board B in a preferable state.

In this embodiment, moreover, in order to securely achieve tail protection during transportation in the longitudinal direction of the connector 1, it is desirable that a length L2 between the fixed portions 18 and 18 of the down hold member 12 is set larger than a length L3 between the solder tails 6 and 6 of the female terminal 4. In particular, in the case where the length L2 between the fixed portions 18 and 18 is set at the same as the length L, between the projecting portions 20 and 20, both fixed portion 18 and projecting portion 20 abut against both side walls of the receiving groove 50 of the tray T, so that the connector 1 can be more securely positioned in the receiving groove 50.

Figure 5:
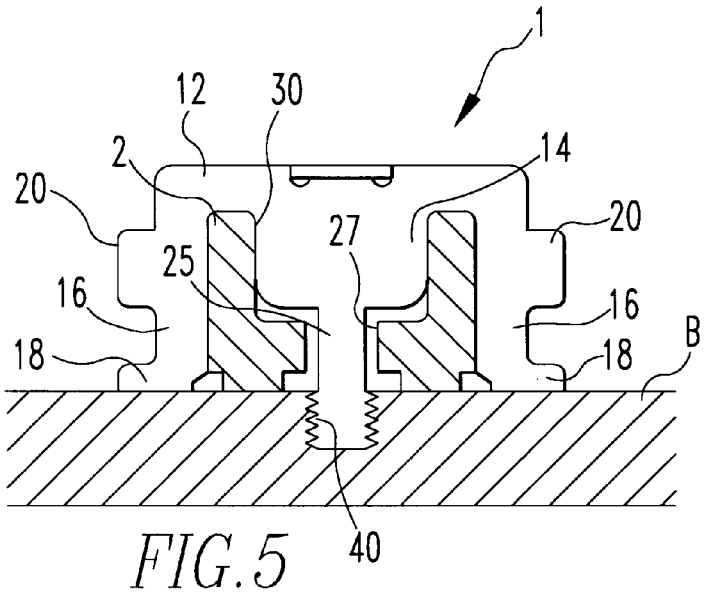
FIG. 5 is a cross-sectional view showing parts corresponding to FIG. 3 of an electric connector according to a modification example of FIG. 1.
Figure 6:
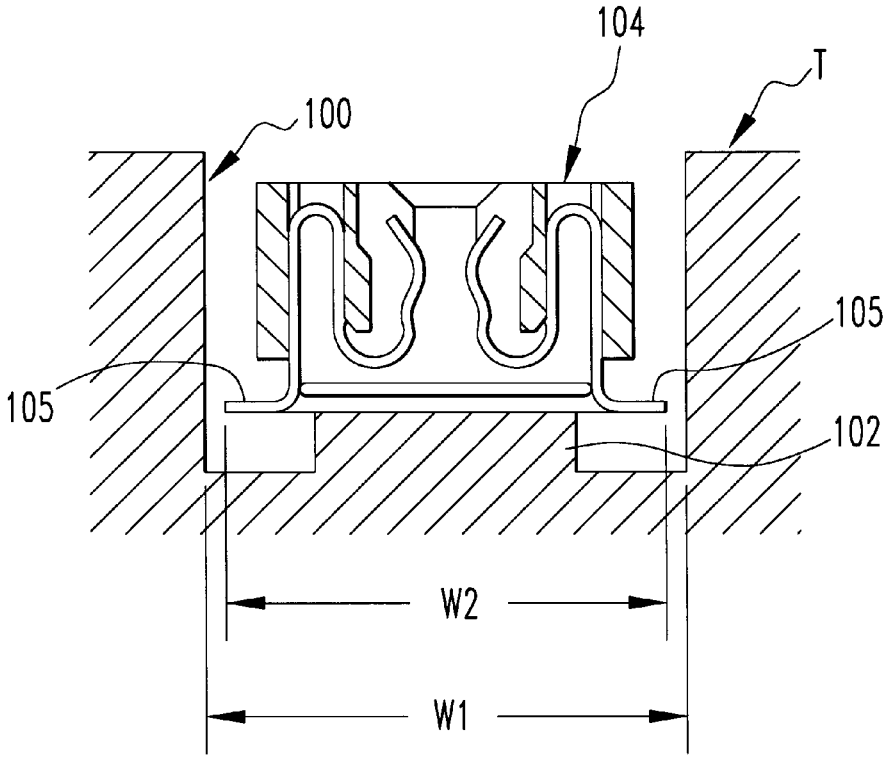
FIG. 6 is a cross-sectional view as taken along a connector width direction in a state in which a conventional electric connector is received in a receiving groove of a transportation tray.

As shown in FIG. 5, the hold down member 12 may be provided with an engagement portion 25 which is momentarily held in the printed circuit board B. In this case, as shown in the figure, the engagement portion 25 is provided in the convex portion 14 of the hold down member 12, and extends downward on the inner side of the hold down member 12. Also, in a state in which the hold down member 12 is fitted into the housing 2 as shown in FIG. 5, the engagement portion 25 extends through a hole 27 penetrating from the concave groove 30 of the housing 2 to the lower face thereof, and projects from the lower face of the housing 2. Further, the surface of the lower end portion of the engagement portion 25 is formed with an engagement means which is capable of engaging with a groove 40 formed in the printed circuit board B. The engagement means may be, for example, a screw portion formed in the surface of the engagement portion 25, or a fine protrusion formed in the surface of the engagement portion 25. Namely, the engagement means may of course be any other form so long as the engagement portion 25 can be momentarily held in the groove 40 by friction.

If the aforesaid engagement portion 25 is provided in the hold down member 12, the connector 1 is not shaky when soldering the female terminal 4 and the fixed portion 18 of the hold down member 12 onto the printed circuit board B; therefore, the soldering operation can be readily achieved. This exhibits the effect when the soldering operation is carried out by manually, and not automatic mounting.

As is evident from the above explanation, in the electric connector of the present device, mounting density on the printed circuit board can be enhanced, and also, tail protection during transportation can be improved without causing failure in the connector manufacture process and increasing manufacture cost of the transportation tray for the connector.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. An electric connector mounted on a printed circuit board, comprising:

a housing which is molded from an electrically insulating material, and has a lower face facing a printed circuit board mounted to the printed circuit board and an upper face situated opposite to the lower face;

a plurality of terminals which are held at predetermined intervals along a longitudinal direction of the housing, each having a tail portion projecting from the lower face of the housing and soldered to the printed circuit board; and a retaining member which is fitted on opposite, outwardly facing outer sides of the housing in the longitudinal direction thereof, and holds down the housing on the printed circuit board from the top of the housing by being soldered to the printed circuit board.

2. An electric connector mounted on a printed circuit board, comprising:

a housing which is molded from an electrically insulating material, and has a lower face facing a printed circuit board mounted to the printed circuit board and an upper face situated opposite to the lower face;

a plurality of terminals which are held at predetermined intervals along a longitudinal direction of the housing, each having a tail portion projecting from the lower face of the housing and soldered to the printed circuit board; and a retaining member which is fitted on opposite, outwardly facing sides of the housing in the longitudinal direction thereof so as to cover a train of the terminals from both sides in its longitudinal direction, and holds down the housing on the printed circuit board from the top of the housing by being soldered to the printed circuit board.

3. An electric connector mounted on a printed circuit board, comprising:

a housing which is molded from an electrically insulating material, and has a lower face facing a printed circuit board mounted to the printed circuit board and an upper face situated opposite to the lower face;

a plurality of terminals, which are held at predetermined intervals along a longitudinal direction of the housing, each having a tail portion projecting from the lower face of the housing and soldered to the printed circuit board; and a retaining member which is fitted on opposite, outwardly facing outer sides of the housing in the longitudinal direction thereof, and holds down the housing on the printed circuit board from its top by being soldered to the printed circuit board, the retaining member being provided with positioning means which positions the housing in a connector receiving groove formed in a transportation tray for carrying the electric connector.

4. An electric connector mounted on a printed circuit board, comprising:

a housing which is molded from an electrically insulating material, and has a lower face facing a printed circuit board mounted to the printed circuit board and an upper face situated opposite to the lower face;

a plurality of terminals which are held at predetermined intervals along a longitudinal direction of the housing, each having a tail portion projecting from the lower face of the housing and soldered to the printed circuit board; and a retaining member which is fitted on opposite, outwardly facing outer sides of the housing in the longitudinal direction thereof, and holds down the housing on the printed circuit board from the top of the housing by being soldered to the printed circuit board, the retaining member being provided with positioning means which positions the housing in a connector receiving groove formed in a transportation tray for carrying the electric connector so as to prevent the tail portion and side walls of the connector receiving groove from contacting with each other.

5. An electric connector mounted on a printed circuit board, comprising:

a housing which is molded from an electrically insulating material, and has a lower face facing a printed circuit board mounted to the printed circuit board and an upper face situated opposite to the lower face;

a plurality of terminals which are held at predetermined intervals along a longitudinal direction of the housing, each having a tail portion projecting from the lower face of the housing and soldered to the printed circuit board; and a retaining member which is fitted on opposite, outwardly facing outer sides of the housing in the longitudinal direction thereof, and holds down the housing on the printed circuit board from the top of the housing by being soldered to the printed circuit board, the retaining member being provided at its both side ends with projecting portions which abut against side walls of a connector receiving groove formed in a transportation tray for carrying the electric connector and which position the housing in the connector receiving groove so as to prevent the tail portion and the side walls of the connector receiving groove from contacting with each other.

6. An electric connector mounted on a printed circuit board, comprising:

a housing which is molded from an electric insulating material, and has a lower face facing a printed circuit board when being mounted to the printed circuit board and an upper face situated opposite to the lower face;

a plurality of terminals which are held at predetermined intervals along a longitudinal direction of the housing, each having a tail portion projecting from the lower face of the housing and soldered to the printed circuit board; and a retaining member which is fitted on opposite, outwardly facing sides of the housing in the longitudinal direction thereof, and holds down the housing on the printed circuit board from its top by being soldered to the printed circuit board, the retaining member being provided with projecting portions which abut against side walls of a connector receiving groove formed in a transportation tray for carrying the electric connect or and which position the housing in the connector receiving groove so as to prevent the tail portion and the side walls of the connector receiving groove from contacting with each other, and an engagement portion which momentarily holds the retaining member on the printed circuit board by engaging with the printed circuit board.

7. An electric connector mounted on a printed circuit board, comprising:

a housing which is molded from an electrically insulating material, and has a lower face facing a printed circuit board mounted to the printed circuit board and an upper face situated opposite to the lower face;

a plurality of terminals which are held at predetermined intervals along a longitudinal direction of the housing, each having a tail portion projecting from the lower face of the housing and soldered to the printed circuit board; and a retaining member which is fitted on both sides of the housing in the longitudinal direction thereof so as to cover a train of the terminals from opposite, outwardly facing outer sides in its longitudinal direction, and holds down the housing on the printed circuit board from the top of the housing by being soldered to the printed circuit board, the retaining member being formed by blanking, and having a convex portion which is fitted into a concave groove formed on the upper face of the housing, a pair of leg portions which is formed integrally with the convex portion and extends downward so as to be fitted along a side face of the housing, and a fixed portion formed at a lower end portion of the leg portion, which extends so as to be bent outward with a predetermined flatness and is soldered to a surface of the printed circuit board.

8. An electric connector mounted on a printed circuit board, comprising:

a housing which is molded from an electrically insulating material, and has a lower face facing a printed circuit board mounted to the printed circuit board and an upper face situated opposite to the lower face;

a plurality of terminals which are held at predetermined intervals along a longitudinal direction of the housing, each having a tail portion projecting from the lower face of the housing and soldered to the printed circuit board; and a retaining member which is fitted on opposite, outwardly facing outer sides of the housing in the longitudinal direction thereof so as to cover a train of the terminals from both sides in its longitudinal direction, and holds down the housing on the printed circuit board from the top of the housing by being soldered to the printed circuit board.

the retaining member being formed by blanking, and having a convex portion which is fitted into a concave groove formed on the upper face of the housing, a pair of leg portions which is formed integrally with the convex portion and extends downward so as to be fitted along a side face of the housing, a fixed portion formed at a lower end portion of the leg portion, which extends so as to extend outwardly with a predetermined flatness and is soldered to a surface of the printed circuit board, and projecting potions which abut against side walls of a connector receiving groove formed in a transportation tray for carrying the electric connector and which position the housing in the connector receiving groove so as to prevent the tail portion and the side walls of the connector receiving groove from contacting with each other.

9. An electric connector mounted on a printed circuit board, comprising:

a housing which is molded from an electrically insulating material, and has a lower face facing a printed circuit board mounted to the printed circuit board and an upper face situated opposite to the lower face;

a plurality of terminals which are held at predetermined intervals along a longitudinal direction of the housing, each having a tail portion projecting from the lower face of the housing and soldered to the printed circuit board; and a retaining member which is fitted on opposite, outwardly facing outer sides of the housing in the longitudinal direction thereof so as to cover a train of the terminals from both sides in its longitudinal direction, and holds down the housing on the printed circuit board from its top by being soldered to the printed circuit board, the retaining member being formed by punching, and having a convex portion which is fitted into a concave groove formed on the upper face of the housing, a pair of leg portions which is formed integrally with the convex portion and extends downward so as to be fitted along a side face of the housing, a fixed portion formed at a lower end portion of the leg portion, which extends so as to extend outwardly with a predetermined flatness and is soldered to a surface of the printed circuit board, projecting portions which abut against side walls of a connector receiving groove formed in a transportation tray for carrying the electric connector and which position the housing in the connector receiving groove so as to prevent the tail portion and the side walls of the connector receiving groove from contacting with each other, and an engagement portion which momentarily holds the retaining member on the printed circuit board by engaging with the printed circuit board.

* * * * *